US006769656B1

(12) United States Patent
Botkin et al.

(10) Patent No.: US 6,769,656 B1
(45) Date of Patent: Aug. 3, 2004

(54) ASSEMBLY FOR SUPPORTING AND DISPLAYING OBJECTS

(76) Inventors: Kirk Jeffrey Botkin, 4995 Maple Grove Rd., Martinsville, IN (US) 46151; Monte Duane Botkin, 8820 W. 46th St., Indianapolis, IN (US) 46234

( * ) Notice: Subject to any disclaimer, the term of this patent is extended or adjusted under 35 U.S.C. 154(b) by 0 days.

(21) Appl. No.: 10/351,047

(22) Filed: Jan. 24, 2003

(51) Int. Cl.[7] ..... A47F 1/00

(52) U.S. Cl. ..... 248/220.31; 248/222.51; 211/57.1; 211/59.1

(58) Field of Search ..... 248/220.31, 220.42, 248/220.43, 222.51; 211/57.1, 59.1, 105.1, 106.01, 87.01

(56) References Cited

U.S. PATENT DOCUMENTS

| | | | | |
|---|---|---|---|---|
| 288,058 | A | * 11/1883 | Hollister | 248/315 |
| 698,272 | A | * 4/1902 | Glover | 211/39 |
| 1,247,938 | A | * 11/1917 | Curtenius | 248/224.8 |
| 1,802,245 | A | * 4/1931 | Foretich | 108/186 |
| 2,895,616 | A | 7/1959 | Erdmann | |
| 4,150,753 | A | 4/1979 | Stahl et al. | |
| 4,155,459 | A | 5/1979 | Marschak | |

(List continued on next page.)

FOREIGN PATENT DOCUMENTS

| | | | | |
|---|---|---|---|---|
| DE | 3335214 A1 | * 4/1985 | | 248/220.31 |
| FR | 2546048 A1 | * 11/1984 | | 248/220.31 |
| GB | 6413 | * 4/1892 | | 248/222.51 |

OTHER PUBLICATIONS

Spacewall International, Spacewall World Wide Brochure.
Spacewall International, New Products Brochure.
Australian Slatwall Industries, Ultrapuck, www.asionline.com.au/content/view.asp?id=149.
Triodisplay, Puck Wall, www.triodisplay.com/ITEMS1/puck_wall.htm.
Pam International, Linx, www.pamint.com/linx.html.
Marlite, Mono, Visplay from Marlite Brochure.
Marlite, Endless Possibilities, Visplay from Marlite Brochure.
Marlite, Stripes, Visplay from Marlite Brochure.
Walls+Forms, Inc., Plug+Display Advertisement.

*Primary Examiner*—Leslie A. Braun
*Assistant Examiner*—Jon Szumny
(74) *Attorney, Agent, or Firm*—Woodard, Emhardt, Moriarty, McNett & Henry LLP

(57) ABSTRACT

An assembly for supporting a cantilever bracket and an assembly for supporting an object. The assemblies include a mounting structure having a first surface and an opposite surface and defining an opening therebetween. A relief is defined at a distance from the first surface and surrounding a portion of the opening. An engagement member has a body that is engageable within the opening, a retaining flange projecting from the first end of the body and shaped to be received within the relief, and a retaining member disposed on the opposite end and having a bearing surface. A cantilever support member projects from the retaining member.

23 Claims, 15 Drawing Sheets

U.S. PATENT DOCUMENTS

| | | | | | |
|---|---|---|---|---|---|
| 4,186,666 | A | | 2/1980 | Honickman | |
| 4,194,637 | A | | 3/1980 | Edson | |
| 4,322,006 | A | | 3/1982 | Marschak | |
| 4,323,215 | A | | 4/1982 | Berger | |
| 4,502,602 | A | | 3/1985 | Swanson | |
| 4,671,417 | A | | 6/1987 | O'Brien | |
| 4,750,700 | A | | 6/1988 | Wade | |
| 4,889,304 | A | | 12/1989 | Glickman et al. | |
| 4,936,565 | A | | 6/1990 | Fredrickson | |
| 5,109,993 | A | * | 5/1992 | Hutchison | 211/87.01 |
| 5,354,103 | A | | 10/1994 | Torrence et al. | |
| 5,370,249 | A | | 12/1994 | Harvey et al. | |
| 5,492,295 | A | | 2/1996 | Remmers | |
| 5,529,192 | A | | 6/1996 | Conen et al. | |
| 5,582,376 | A | | 12/1996 | Thompson | |
| 5,607,070 | A | | 3/1997 | Hellyer | |
| 5,611,438 | A | | 3/1997 | Dye | |
| 5,626,243 | A | | 5/1997 | Brozak, Jr. | |
| 5,676,258 | A | * | 10/1997 | Leyden et al. | 211/7 |
| 5,678,702 | A | | 10/1997 | Menaged et al. | |
| 5,803,274 | A | | 9/1998 | Scheveloff | |
| 5,833,077 | A | | 11/1998 | Engel | |
| 5,908,119 | A | | 6/1999 | Kump et al. | |
| 5,927,517 | A | | 7/1999 | Lipman et al. | |
| 6,015,124 | A | | 1/2000 | Loy | |
| 6,029,827 | A | | 2/2000 | Valiulis | |
| 6,053,115 | A | | 4/2000 | Felton | |
| 6,186,455 | B1 | | 2/2001 | Hollingsworth et al. | |
| 6,193,083 | B1 | | 2/2001 | Wood | |
| 6,209,831 | B1 | | 4/2001 | Kiplinger | |
| 6,234,436 | B1 | | 5/2001 | Kump | |

* cited by examiner

ASSEMBLY FOR SUPPORTING AND DISPLAYING OBJECTS

FIELD OF THE INVENTION

The present invention relates to brackets for supporting and displaying objects.

BACKGROUND OF THE INVENTION

Retailers and product manufacturers are in the business of selling products, and to stay competitive, they must continually consider how products are perceived by customers. Although product fixtures by their very function typically serve a supporting role, they are a key component in creating customer perception. The function of product fixtures is to facilitate profitability by enhancing products while maximizing use of retail space. While retailers of lower end products may focus more on the retail space aspect and higher end retailers focus on enhancing the image of products and the retail store, both types of retailers use product fixtures to increase sales.

A poorly designed, manufactured, installed or maintained fixture can destroy an otherwise positive product image. A product fixture should focus attention on the product and never call attention to itself by wobbling or impeding access to the product. Such problems are frustrating to shoppers who may then unconsciously associate poor quality with the product or the store.

Certain products are best displayed with faceout or waterfall displays. Such displays allow product, such as garments, to be stored and displayed in an optimal way for highlighting the product and ensuring that sufficient stock is ready and available for selection and purchase. Faceout and waterfall display brackets can be mounted on wall standards or freestanding fixtures.

Wall standards are typically elongated chrome structures having numerous slots for attachment of brackets for display devices, such as shelves, hooks, faceouts and waterfall displays. One advantage of the use of wall standards is that the display devices can be placed at various levels as products and stock changes. Wall standards also provide some stability if installed properly. Unfortunately, the stability provided by wall mounts is limited by the security of the engagement of the slot to the attachment members provided on the display members.

Freestanding fixtures provide flexibility because they can be moved around the store, however they present an additional stability problem. Such displays can wobble. The problem is magnified with the use of faceout and waterfall accessories, which can increase the wobble factor. The instability of some chrome fixtures is a safety issue and also detracts from the customer's shopping experience; both of which are bad for profitability.

In addition to stability issues, typical slot walls, whether of metal or wood, require a great deal of labor to manufacture. It would be preferable to bore holes, however it has been previously impossible to create a single piece fixture that can be readily engaged and disengaged with a bored opening. Pegs created for round holes freely rotate and cannot support a cantilever bracket of any length. Moreover, the typical chrome displays do not tend to enhance the image of products and stores. Many high-end retailers and manufacturers seek product displays that support and enhance the desired image.

One approach is the assembly shown in FIG. 1. Assembly 1 includes a peg 4 attached to three-spaced disc members

7,8,9 for engaging a hole 3 drilled in a support 2. One of the end discs 7 has a diameter that is less than the diameter of the hole 3 and can be placed through the hole 3. Once disc 6 is passed through hole 3, a portion 6 of peg 4 is allowed to rest within hole 3. The middle disc 8 has a diameter that is large enough to conceal hole 3 when the portion 6 is resting within hole 3. Middle disc 8 also helps retain peg 4 within hole 3. The outer portion 5 of peg 4 provides a place to hang a garment, and outer disc 9 serves as a stop for a hanger.

While the device shown in FIG. 1 provides an attractive fixture, it suffers from significant drawbacks. For example, while peg 4 can appear stably fixed to the support 2, the peg wobbles within the hole and can be inadvertently removed when a hanger is removed from the peg. This could be hazardous to an unsuspecting customer or employee and could result in significant liability. In addition, due to the design, the outer portion of the peg cannot be much longer than the depth of the hole or the peg will fall out of the hole. With a support 2 having a depth of about ¾ inches, the design has a limited capacity of one to a few garments, which does not facilitate economical use of retail space. Moreover, customers are forced to search for the stock that relates to the display, which does not promote sales. Therefore, the design shown in FIG. 1 does not solve the need for attractive, image-enhancing fixtures that are economical and versatile.

The challenge has been to design fixtures with positive image qualities that are functional, stable, versatile and space-efficient. Therefore, a need remains for new product fixtures.

SUMMARY OF THE DISCLOSURE

The present invention provides an assembly for supporting an object that includes a mounting structure having a first surface, an opposite surface and an opening therebetween. A relief or a bevel defining a relief surface surrounds a portion of the opening at a distance from the first surface. In a particular aspect of the invention, the relief is formed in the opposite surface of the mounting structure. An engagement body is engageable within the opening and a retaining flange projects from the body. The flange is shaped so that it can be received within the relief. The body defines an upper surface on an upper portion of the body and an opposite lower cam surface on a lower portion of the body. The flange defines a relief bearing surface and a leading edge having a width that is smaller than the dimension of the opening. The engagement body has a first height between the upper and lower cam surfaces that is less than a height of the opening and a second height between the leading edge and the lower cam surface that is greater than the height of the opening.

A retaining member, which has a first side and an opposite side, is attached to the engagement body adjacent to the lower cam surface. A cantilever support member having an attached end connects to the first side of the retaining member. The opposite end of the cantilever support member projects from the retaining member. The engagement body is engageable within the opening with the flange disposed within the relief and a bearing surface on the opposite side of the retaining member bearing against the first surface of the mounting structure. In one particular embodiment, the retaining member conceals the opening on the first side of the mounting structure.

The invention contemplates many modifications to the basic inventive concept. By ways of example only, in some embodiments, the retaining flange is formed at an angle that is from about 10° to about 45° relative to the upper surface, and the relief is formed at a relief angle between about 45° and about 80° relative to the opposite surface. In one aspect, the retaining flange is formed at an angle of about 25° relative to the upper surface, and the relief is formed at an angle of about 65° relative to the opposite surface. In some cases, the angle of the relief is acute and the flange defines a complementary angle. In addition, the lower cam surface of the assembly can be curved. In one aspect, the body has a rectangular cross-section but in another, it tapers from the upper portion to the lower portion. In certain embodiments, the upper surface has a width that is from about 5 to about 6 times larger than the width of the lower cam surface as it relates to the tapering of the upper portion to the lower portion of the body. In certain embodiments, the width of the leading edge is from about 6 to about 7 times larger than the width of the lower cam surface as it relates to the tapering of the upper portion to the lower portion of the body.

In yet another aspect, the opening is a circular bore and the dimension is the diameter. The relief may be defined around at least one-third of the circumference of the bore. In yet another embodiment, the relief is defined around about one-half of the circumference of the bore. In still another embodiment, the body projects from an upper portion of the opposite side of the retaining plate, and the support member projects from a center portion of the first side of the retaining plate. In some cases, a stop member is attached to the opposite end of the support member. The retaining member can be a plate having a decorative shape.

The present invention also provides an assembly for supporting a cantilever bracket. The assembly includes a mounting structure that has a first surface and an opposite surface with an opening therebetween. The opposite surface includes a relief, which defines a relief surface surrounding a portion of the opening. The relief can be formed at an acute angle that is relative to the opposite surface. The engagement member is engageable within the opening. The engagement member has a body, a retaining flange projecting from the first end of the body and a retaining member disposed on an opposite end of the body and having a bearing surface. The retaining flange defines a relief-bearing surface formed at an angle that is complimentary to the acute angle. The engagement member is engageable within the opening with the flange disposed within the relief with a portion of the relief-bearing surface of the flange bearing against the relief surface and the bearing surface of the retaining member bearing against the first surface of the mounting structure. A fastener is provided for attaching the cantilever bracket to the engagement member wherein the cantilever bracket projects from the first surface when the engagement member is engaged within the opening.

Other features and advantages of the present invention will become readily apparent from the following detailed description, the appended claims and the accompanying drawings. It is to be understood that both the foregoing general description and the following detailed description are exemplary and provided for purposes of explanation only, and are not restrictive of the invention, as claimed.

BRIEF DESCRIPTIONS OF DRAWINGS

Figure 1:
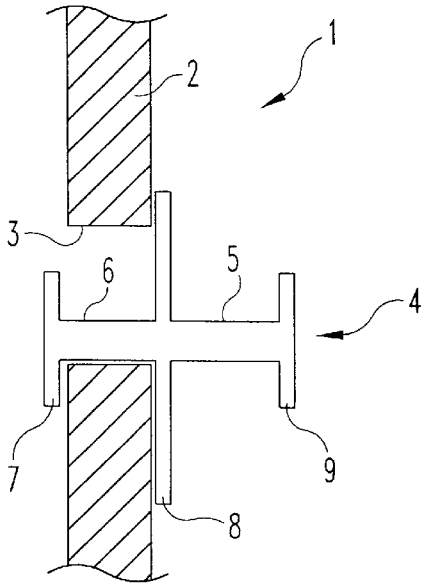
(PRIOR ART) Fig. 1
FIG. 1 is a cross-sectional view of a prior art assembly.

Although the drawings represent embodiments of the present invention, the drawings are not necessarily to scale and certain features may be exaggerated in order to better illustrate and explain the present invention. The exemplification set out herein illustrates certain embodiments of the invention, in one, or more forms, and such exemplifications are not to be construed as limiting the scope of the invention in any manner.

DETAILED DESCRIPTION

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention that would normally occur to one skilled in the art to which the invention relates.

The present invention provides assemblies for supporting and/or displaying objects that are functional, attractive and space-efficient. The devices of this invention can be used in retail stores and other locations, such as homes and factories.

Figure 2:
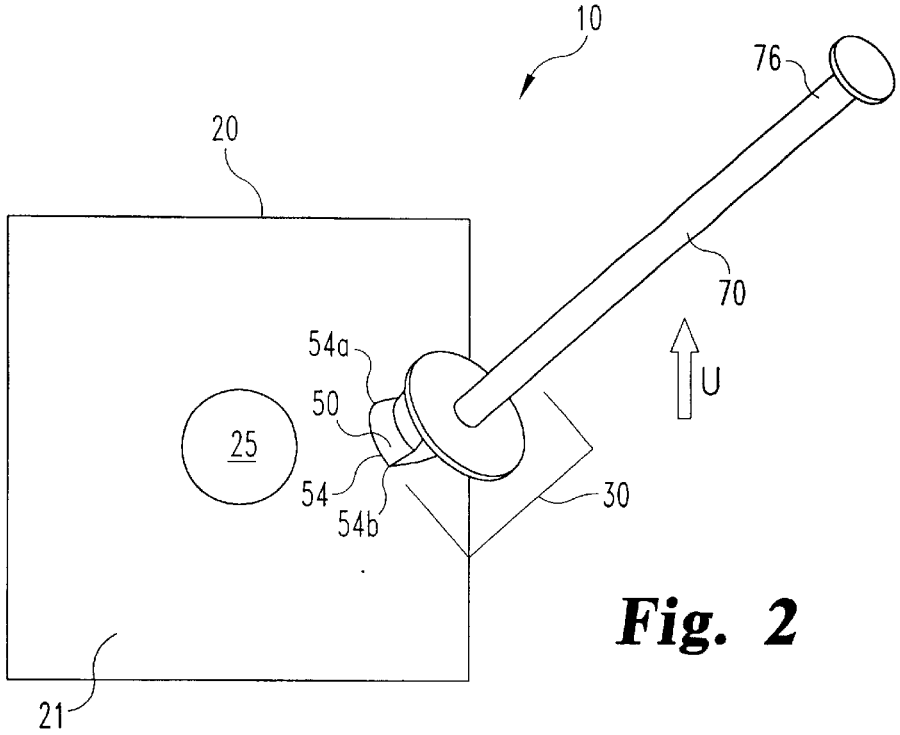
FIG. 2 is a front elevational view of a mounting structure according to one embodiment of this invention.
Figure 3:
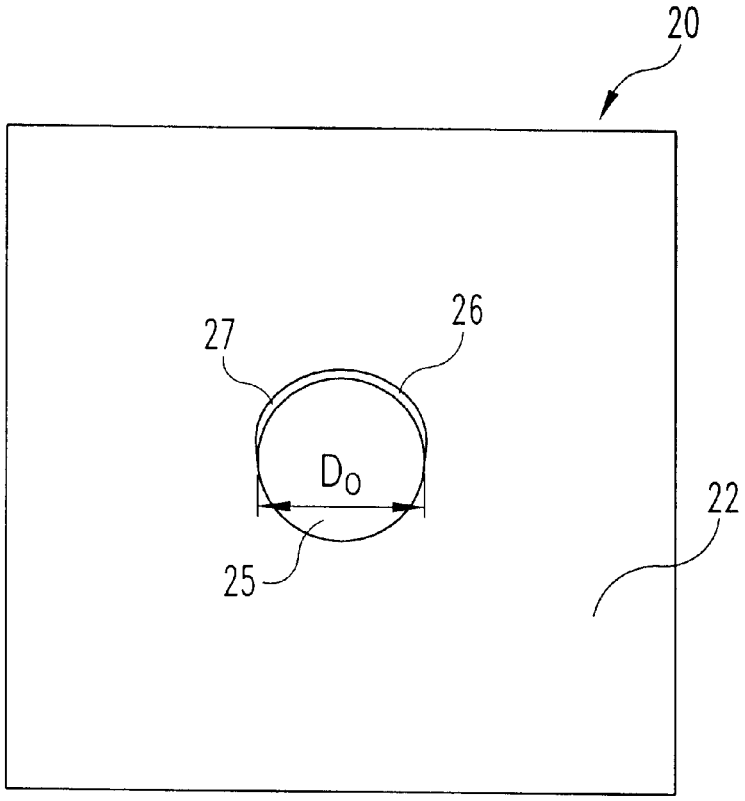
FIG. 3 is a back elevational view of the mounting structure shown in FIG. 2.
Figure 4:
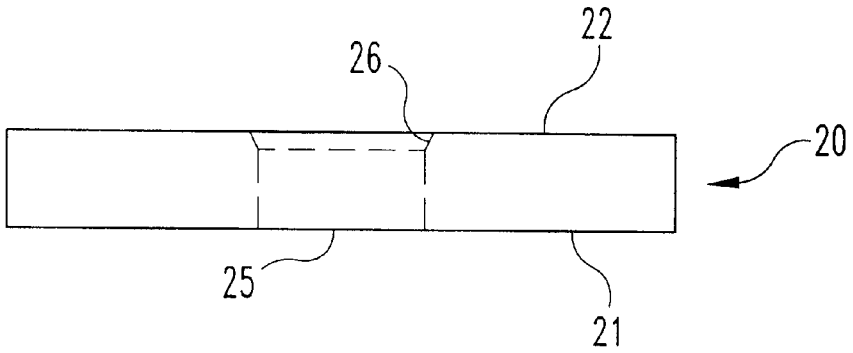
FIG. 4 is a bottom elevational view of the mounting structure shown in FIG. 3.
Figure 5:
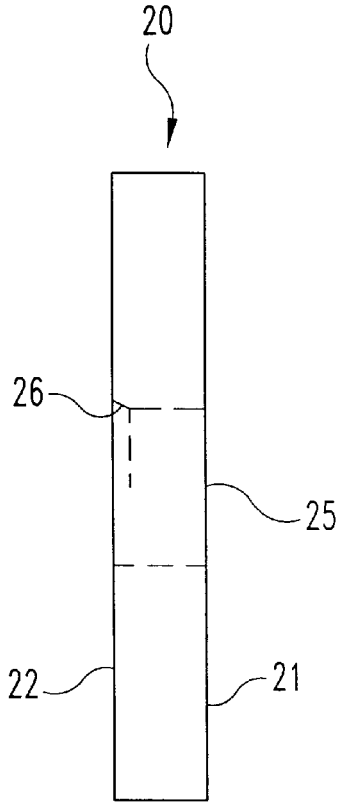
FIG. 5 is a side elevational view of the mounting structure shown in FIG. 3.
Figure 6:
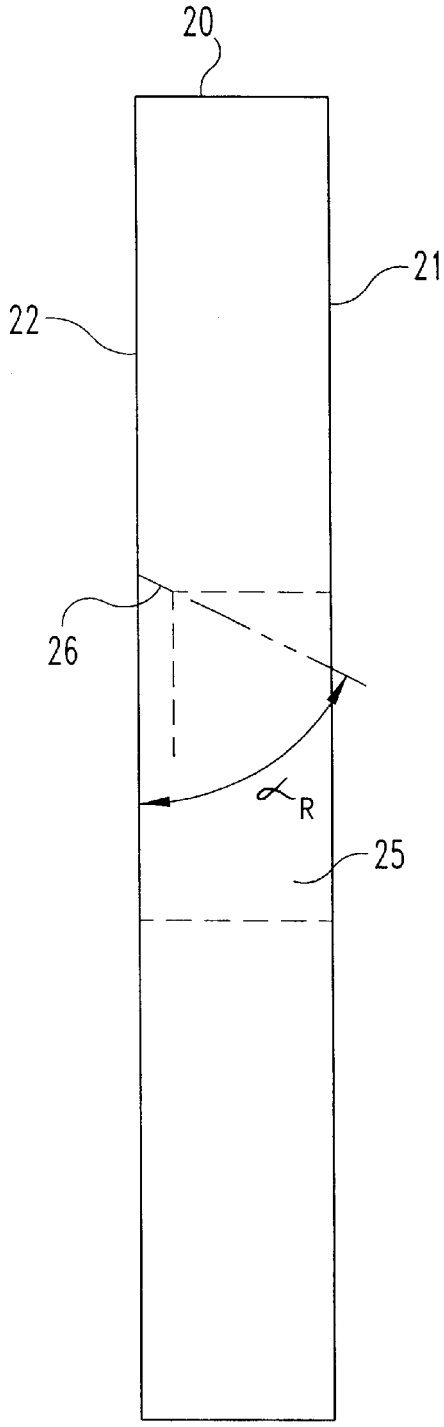
FIG. 6 is an enlarged view of FIG. 5.

FIG. 2 shows an assembly 10 for supporting an object according to one embodiment of this invention. Assembly 10 includes a mounting structure 20 and an engagement member 30. Mounting structure 20 has a first surface 21 and and an opening or a bore 25 defined therein. Engagement member 30 is detachably engageable within opening 25 to support an object.

Referring now to FIGS. 3–6, mounting structure 20 defines a relief 26 surrounding a portion of bore 25 at a distance from first surface 21. In one specific embodiment, relief 26 is formed in an opposite surface 22 of mounting structure 20. Relief 26 may be a bevel formed at a relief angle $\alpha_R$ shown more clearly in FIG. 6. In some embodiments, relief angle $\alpha^R$ is an acute angle relative to the opposite surface 22.

Figure 7:
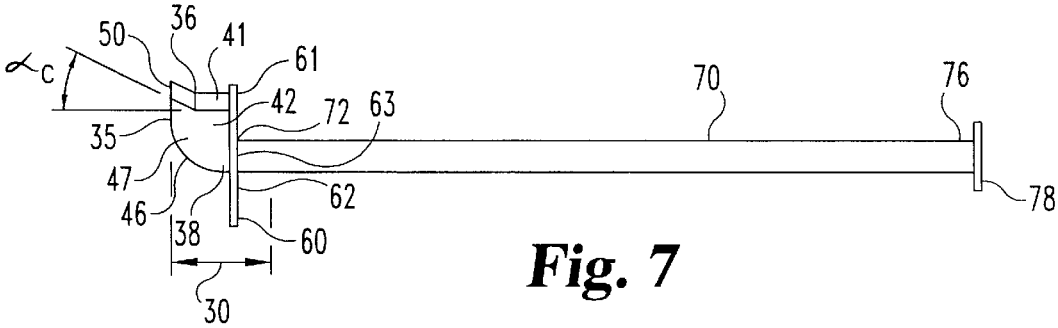
FIG. 7 is a side elevational view of an engagement member and cantilever rod according to one embodiment of this invention.

Referring now to FIG. 7, engagement member 30 includes a body 35, a retaining flange 50 projecting from a first end 36 of body 35 and a retaining member 60 disposed on an opposite end 38 of body 35. Engagement body 35 defines an upper surface 41 on an upper portion 42 of body 35 and an opposite lower cam surface 46 on a lower portion 47 of body 35.

Figure 8:
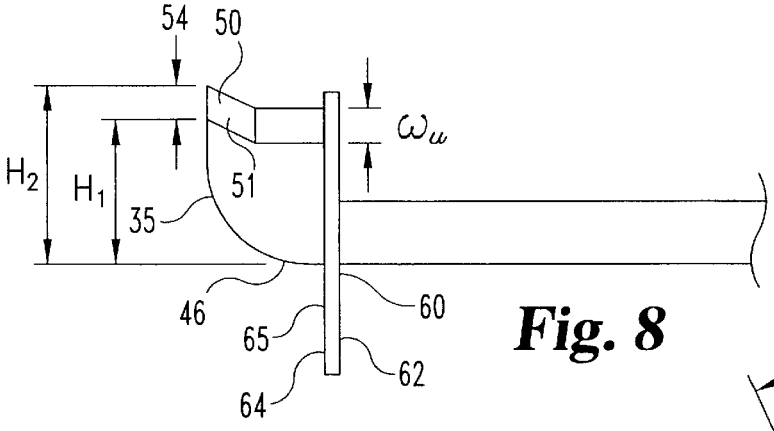
FIG. 8 is an enlarged partial view of FIG. 7.
Figure 9:
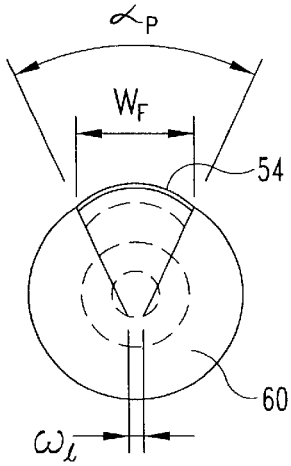
FIG. 9 is an elevational view of one end of the device shown in FIG. 7.
Figure 10:
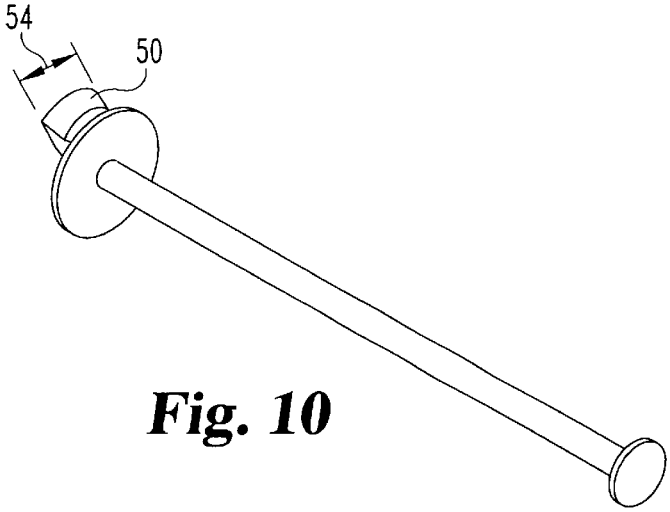
FIG. 10 is a side perspective view of the device shown in FIG. 7.

In certain specific embodiments, such as the one shown in FIG. 7, lower cam surface 46 is curved and engagement body 35 tapers from the upper portion 42 to the lower portion 47 to form a pie shape. For example, upper surface 41 can have a width $W_U$ (FIG. 8) that is about 5 to 6 times larger than a width $W_L$ (FIG. 9) of lower cam surface 46. In such embodiments, the width $W_F$ of leading edge 54 of flange 50 can be from about 6 to about 7 times larger than the width $W_L$. As shown in FIG. 9, engagement body 35 can taper to form a taper angle $\alpha_P$ of up to about 135°. In the particular embodiment shown in FIG. 9, angle $\alpha_P$ is about 50°. Taper angle $\alpha_P$ can be as small as 0° in cases in which engagement body 35 has a rectangular shape. Having a larger flange 50 portion increases the stability of the engagement. At the same time, a tapered lower portion 47 facilitates insertion and removal. It will be understood that these relative dimensions are provided as examples and are not intended to limit the scope of the invention.

Referring now to FIGS. 3 and 6–10, flange 50 is shaped to be received within relief 26 and defines a relief-bearing surface 51 formed at an angle $\alpha_C$ that is complimentary to relief angle $\alpha_R$. In some embodiments, angle $\alpha_C$ is from about 10° to about 45° relative to the upper surface 41 and relief angle $\alpha_R$ is between about 45° and 80° relative to the opposite surface 22 of the mounting structure 20. In specific embodiments, retaining flange 50 is formed at an angle $\alpha_C$ of about 25° relative to upper surface 41 and relief 26 is formed at an angle $\alpha_R$ of about 65° relative to opposite surface 22.

Flange 50 includes a leading edge 54 having a width $W_F$ that is smaller than a dimension $D_O$ of opening 25. Where opening 25 is a circular bore, dimension $D_O$ is the diameter. Engagement body 35 has a first height $H_1$ between the upper surface 41 and the lower cam surface 46 that is less than dimension $D_O$ and a second height $H_2$ between leading edge 54 and lower cam surface 46 that is greater than dimension $D_O$.

Relief 26 will be defined around a portion of the perimeter of opening 25 sufficient to accommodate the width WF of leading edge 54 of flange 50. In one specific embodiment, relief 26 is defined around at least one third of the circumference of opening 25. In another embodiment, relief 26 is formed around about one half of the circumference. In other cases, relief 26 may be formed up to around the entire perimeter.

The relief substantially reduces or prevents twisting or rotation. Rotation of the engagement member is limited to the bevel. In other words, the engagement member 30 cannot be rotated beyond a position in which one of ends 54*a*, 54*b* of the flange 50 extend past either of the ends 26*a*, 26*b* of bevel 26 (FIG. 11).

Figure 12:
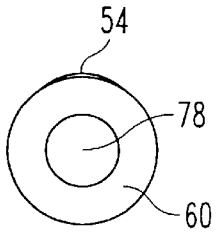
FIG. 12 is an elevational view of the other end of the device shown in FIG. 7.
Figure 14:
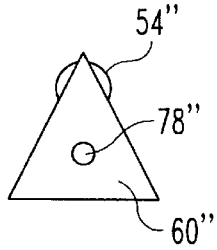
FIG. 14 shows a triangle-shaped retaining member according to another embodiment of this invention.
Figure 13:
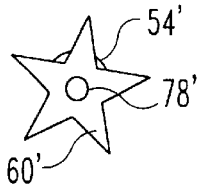
FIG. 13 shows a star-shaped retaining member according to one embodiment of this invention.
Figure 15:
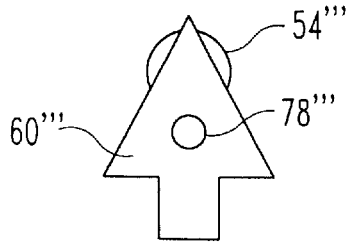
FIG. 15 shows an arrow-shaped retaining member according to yet another embodiment of this invention.

Retaining member 60 has a first side 62 and an opposite side 64 attached to engagement body 35 adjacent the lower cam surface 46. Opposite side 64 defines a bearing surface 65 for bearing against surface 21 of the mounting structure 20. In some embodiments, retaining member 60 is a plate. Retaining member 60 can be fashioned into any desired shape, such as a circle (FIG. 12), a star (FIG. 13), a triangle (FIG. 14), an arrow (FIG. 15) for example or virtually any other shape in these figures, retaining members, 60', 60", 60'"; flange leading edges, 54', 54", 54'" and stop members 78, 78", 78'" are shown.

Referring again to FIG. 7, an object support member 70 projects from engagement member 30. In some specific embodiments, support member 70 is a cantilever support that projects from retaining member 60 in a direction away from engagement member 30. Object support member 70 has an attached end 72 that is connectable to a portion of engagement member 30, such as, for example, first side 62 of retaining member 60. An opposite end 76 of support member 70 projects away from engagement member 30 and retaining member 60. A stop member 78 can be attached to the opposite end 76 of support member 70 to prevent items from slipping off of support member 70.

Figure 11:
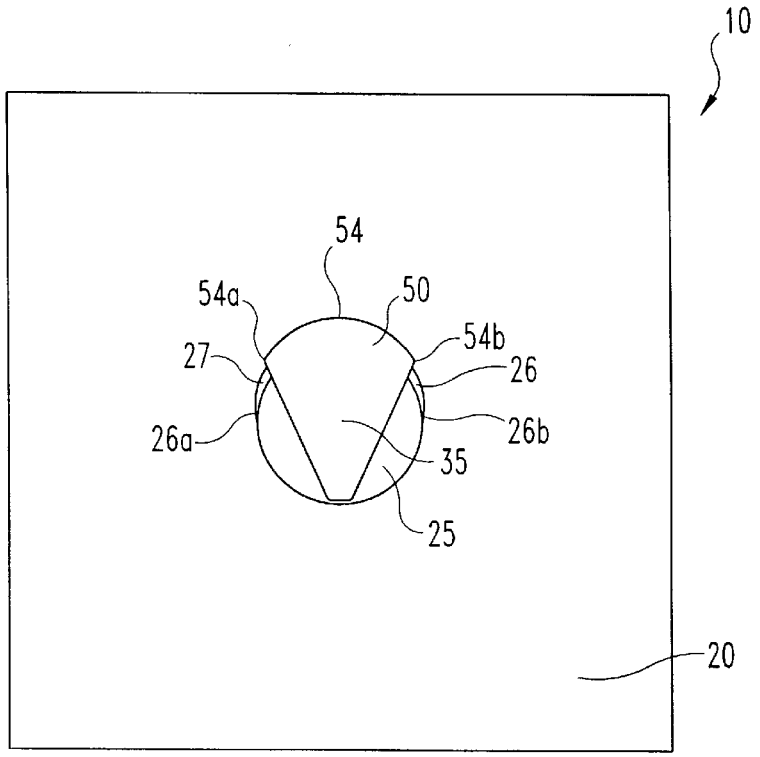
FIG. 11 is a back elevational view of an assembly of this invention.
Figure 16:
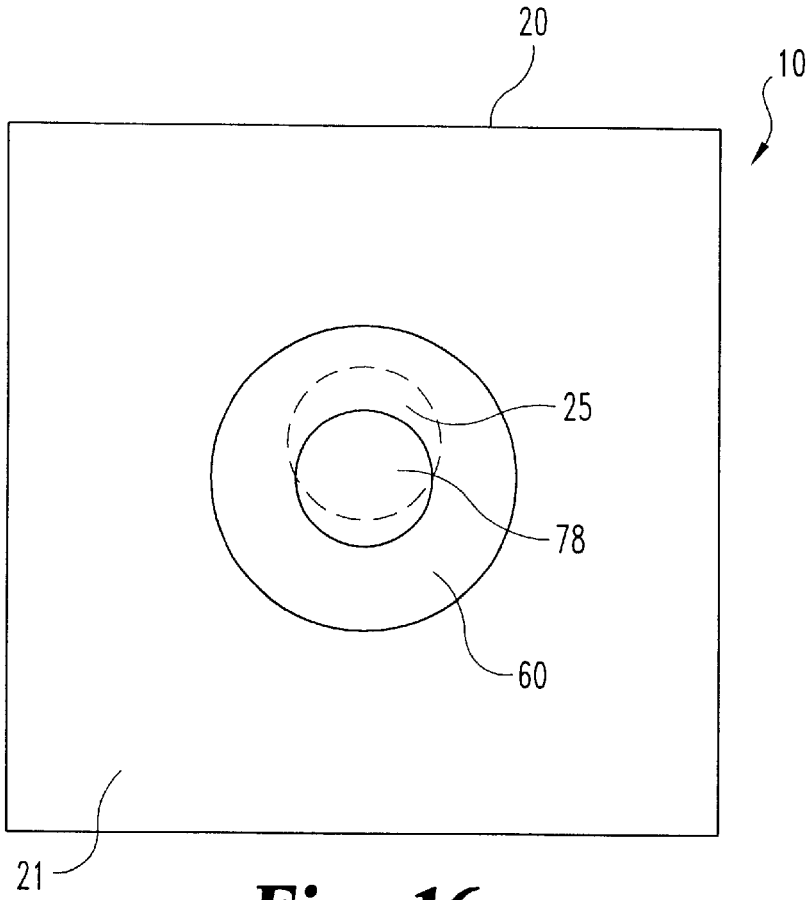
FIG. 16 is a front elevational view of an assembly of this invention.
Figure 17:
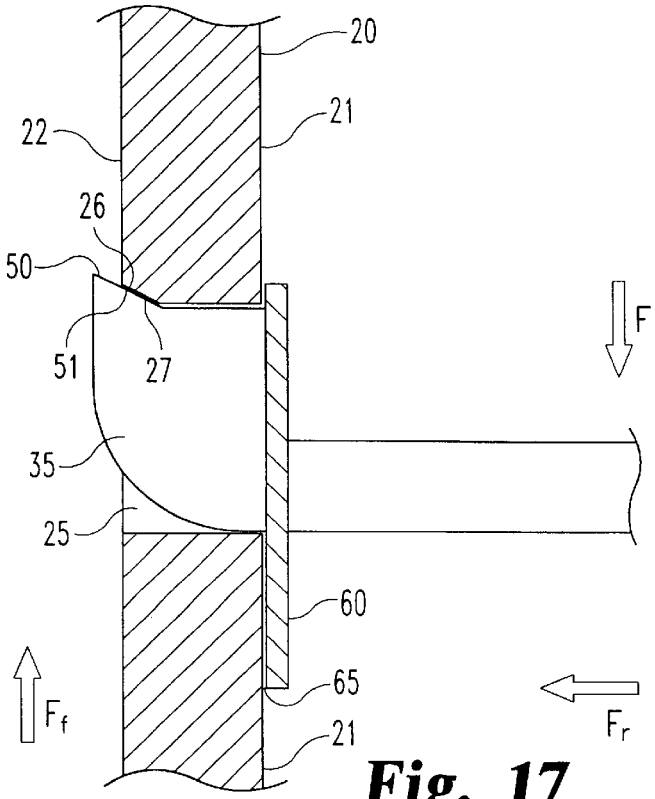
FIG. 17 is a side sectional view of the assembly shown in FIG. 16.

Referring now to FIGS. 11, 16 and 17, the engagement body 35 is engageable within the opening 25 with a portion of flange 50 disposed within the relief 26 and the bearing surface 65 of retaining member 60 bearing against the first surface 21 of mounting structure 20. A portion of the relief-bearing surface 51 of flange 50 bears against the relief surface 27. In one particular embodiment, retaining member 60 conceals opening 25 on the first side 21 of mounting structure 20.

Figure 18:
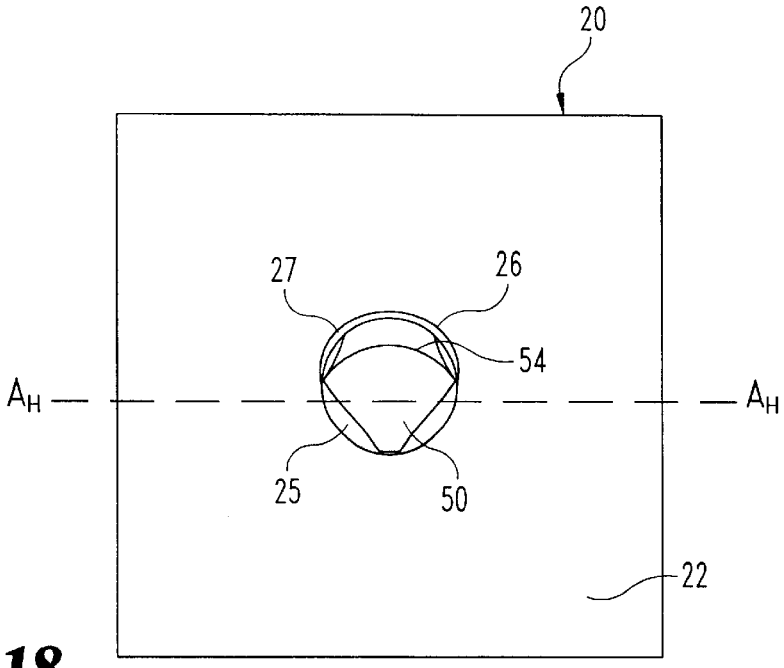
FIG. 18 is a back elevational view of an assembly of this invention showing the first step in the engagement of an engagement member.
Figure 19:
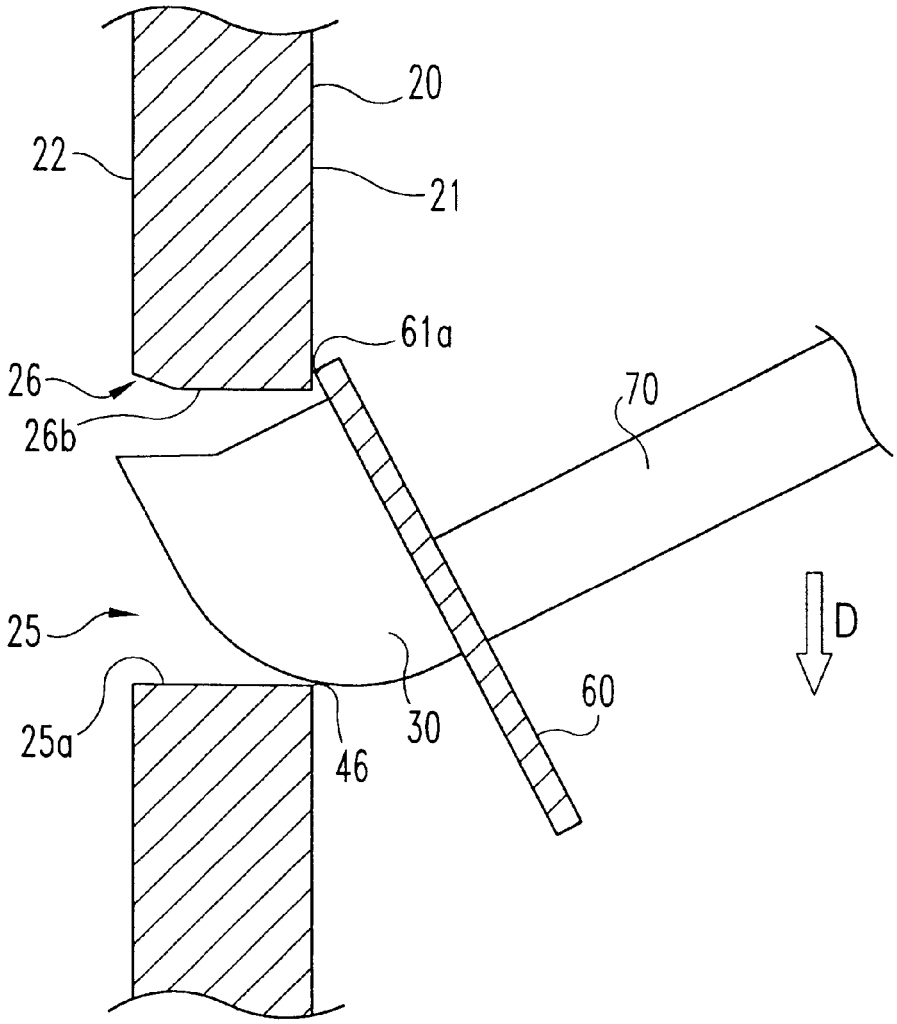
FIG. 19 is a side sectional view of an assembly of this invention with the engagement member positioned in a second step of the engagement with the opening.
Figure 20:
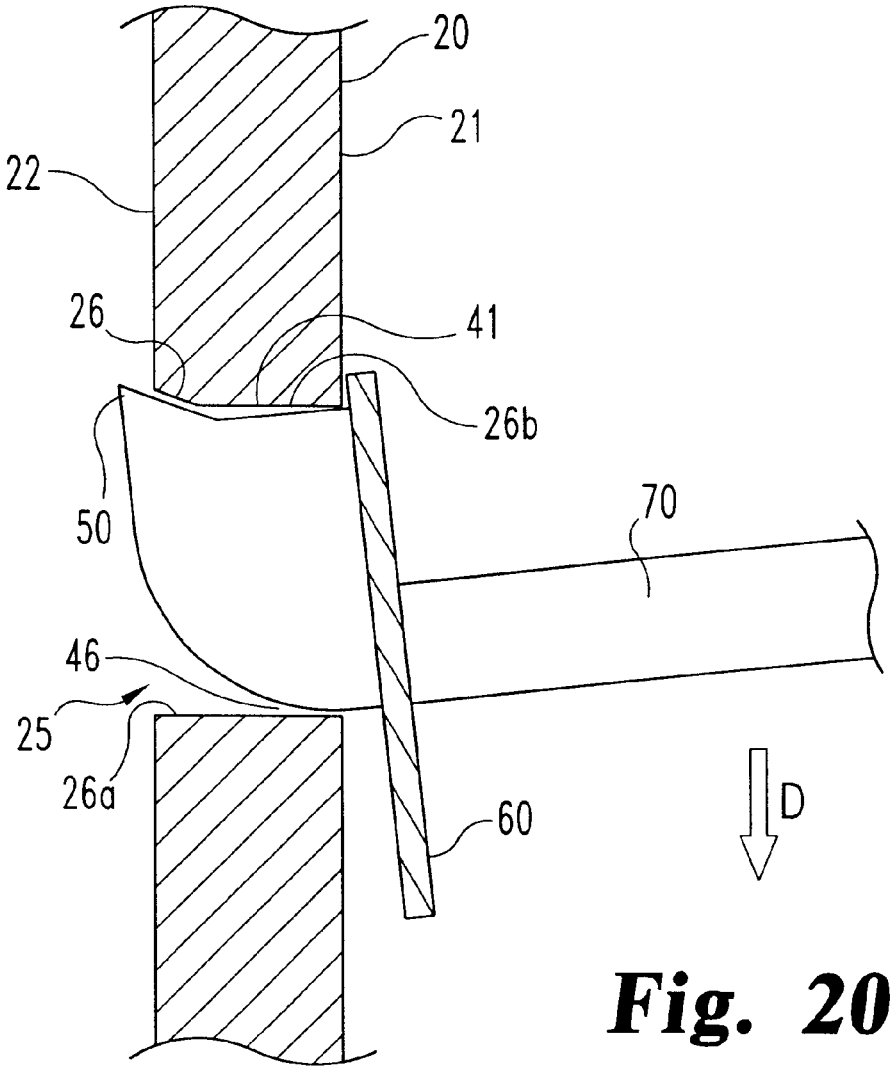
FIG. 20 is a side sectional view of an assembly of this invention with the engagement member positioned in a third step of the engagement with the opening.

In operation, the engagement members 30 of this invention can be engaged within an opening 25 of a support member 20 by tilting the opposite end 76 of support member 70 upwardly in the direction of arrow U as shown in FIG. 2 until leading edge 54 of flange 50 lines up with a portion of opening 25 that is large enough to accept flange 50 as shown in FIG. 18. In some embodiments in which the opening 25 is circular, the portion of the opening 25 that is large enough to accept flange 50 is the horizontal axis $A_H$. Referring now to FIG. 19, as the engagement member 30 is inserted into the opening 25, the upper edge 61*a* of the retaining member 60 contacts the first surface 21 of the support member 20, and the engagement member cannot be inserted any further until the object support member 70 is tilted in a downward direction along arrow D so that the lower cam surface 46 contacts a lower fulcrum surface 25*a* of opening 25. Referring now to FIG. 20, as object support member 70 is further moved downwardly, lower cam surface 46 acts against surface 25*a*. Finally, when object support member 70 is moved into a horizontal position at a 90° angle from support member 20, a portion of flange 50 is received within relief 26 as shown in FIG. 17. To disengage the engagement member 30 from the opening 25, the process is reversed.

When object support member supports an object, the weight of the object creates a downward force along arrow F. The force along arrow F, translates to a force $F_f$ created by flange 50 bearing against the relief surface 27 and a force $F_r$ created by the bearing surface 65 of the lower portion of the retaining member 60 against the first side 21 of support member 20. This configuration creates a stable fixture that can support a substantial amount of weight on a cantilever support member 70.

Figure 21:
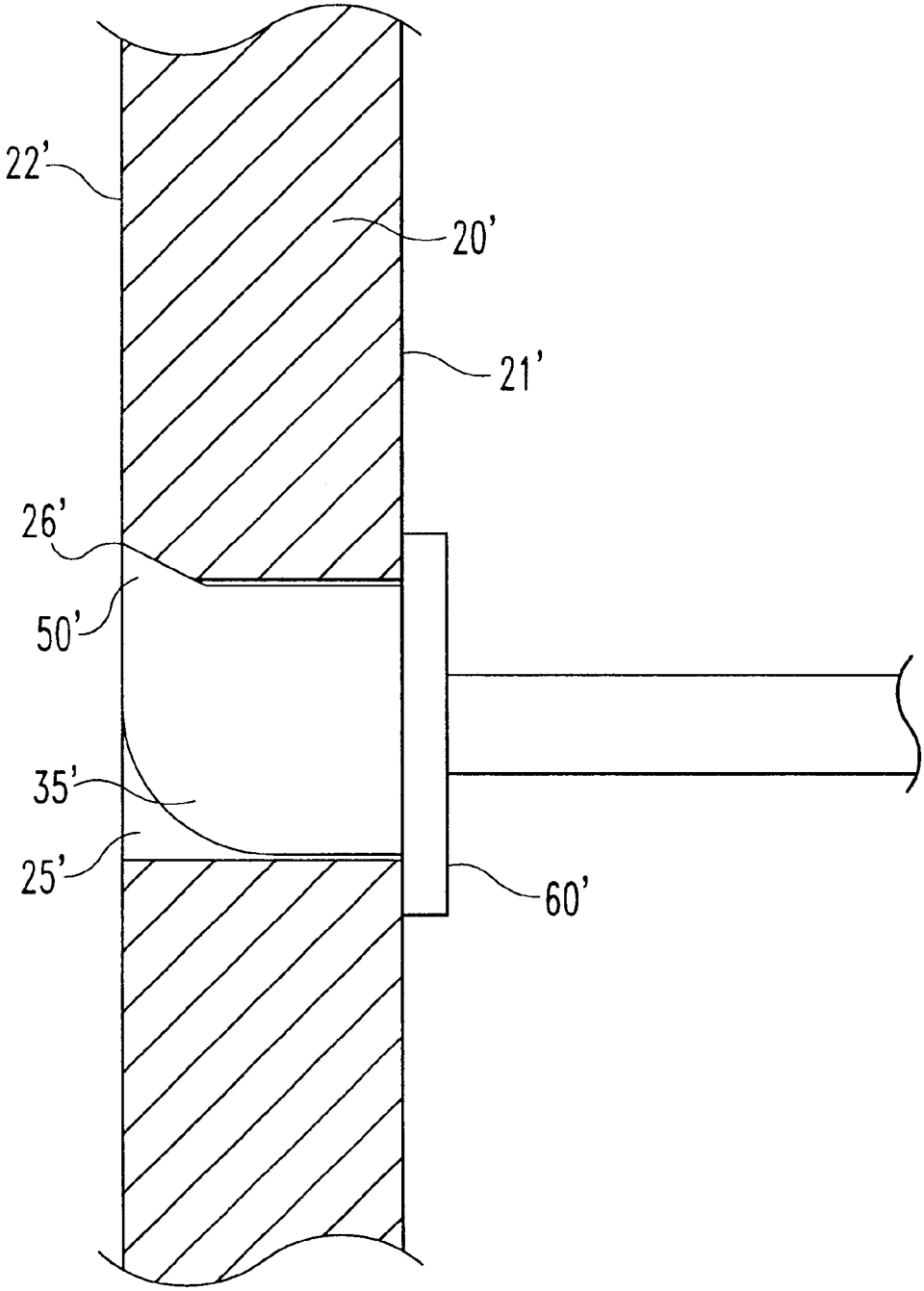
FIG. 21 is a side view of another embodiment of this invention.

In some cases, it may be desirable that the body and flange do not extend beyond the surface of the support. As shown in FIG. 21, engagement body 35' can be sized so that body 35' does not extend past surface 22' when body 35' is disposed within opening 25' with flange 50' disposed within relief 26' with retaining member 60' bearing against first surface 21'.

The assemblies of this invention can be designed to create attractive fixtures. In the specific embodiment shown in FIG. 7, the engagement body 35 projects from an upper portion 61 of the opposite side 64 of the retaining plate 60 and the support member 70 projects from a center portion 63 of the first side 62 of retaining plate 60. Of course, it will be understood that the invention contemplates any suitable arrangement of the components of the assemblies.

Figure 22:
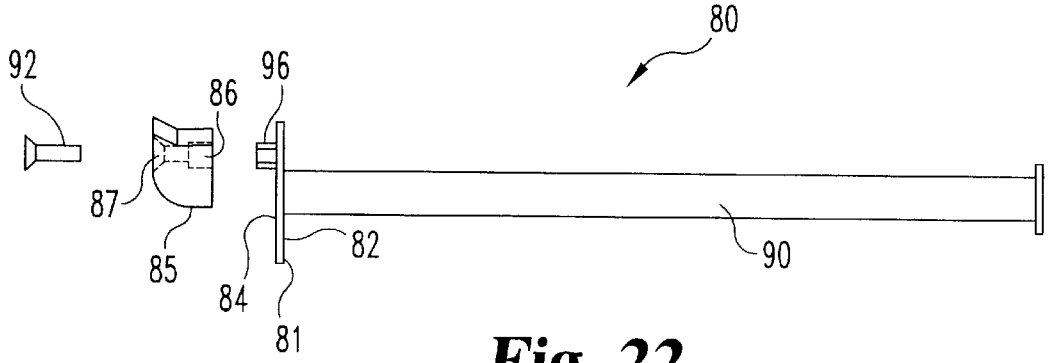
FIG. 22 is a side view of another embodiment of this invention.

The present invention also provides assemblies for supporting cantilever brackets. In one specific embodiment shown in FIG. 22, the assembly 80 includes an engagement body 85 according to this invention plus a fastener 92. Bracket 90 includes cantilever support 88 attached to the first side 82 of retaining member 81. A fastener member 96 that is engageable to fastener 92 is attached to the opposite side 84 of retaining member 81. Engagement body 85 defines a first aperture 86 that corresponds to the shape of fastener member 96 and which communicates with a second aperture 87 that corresponds to fastener 92. It will be appreciated that any suitable fastener arrangement may be employed, such as, for example, a socket head cap screw. The invention can be provided with several different brackets so that the assembly can be set up with various brackets. The present invention is extremely versatile because the brackets can be changed on a whim.

Figure 23:
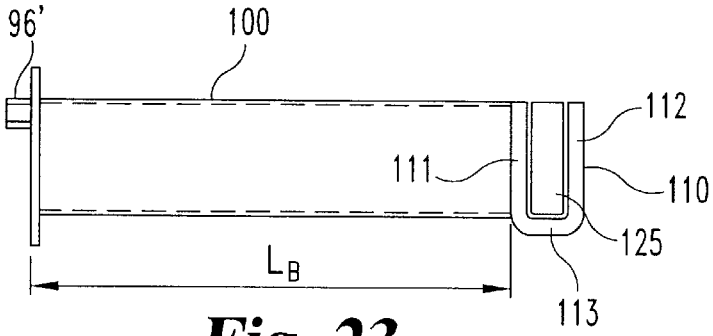
FIG. 23 is a side elevational view of a bracket and rod assembly according to one embodiment of this invention.
Figure 24:
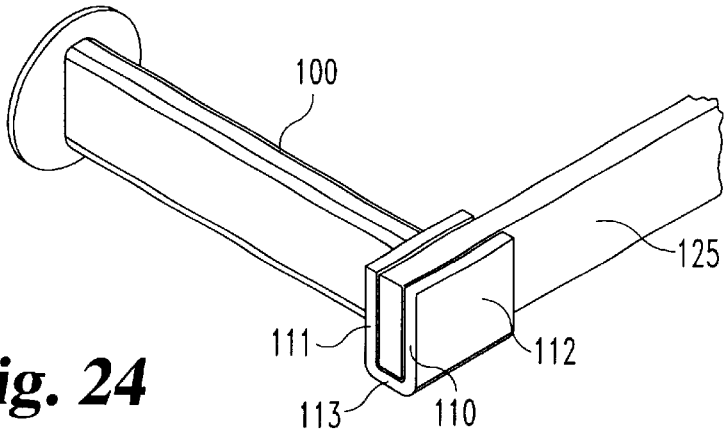
FIG. 24 is a side perspective view of the embodiment shown in FIG. 23.

The present invention can be used to create free standing and wall mount displays, incorporating faceout and cascade brackets. Due to the inherent stability of the present invention, cantilever rods can be used of a length sufficient to support several items in a faceout display. In addition, the present invention can be used for other arrangements. Referring now to FIGS. 23 and 24, another bracket 100 is provided. Bracket 100 can be incorporated into an assembly such as the one shown in FIG. 22 by using fastener member 96 or also as part of the embodiment shown in FIG. 7. Bracket 100 includes an end piece 110 for engaging a support member, such as for example, a hang rod. In this particular embodiment, the end piece 110 has a U-shaped cross section formed by a pair of upstanding walls, 111, 112. A connecting member 113 connects the two walls, 111, 112 to form a U-shape.

Figure 27:
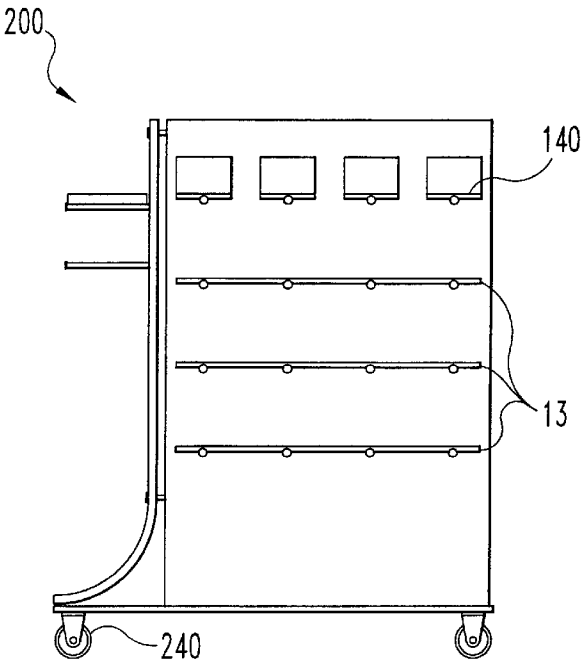
FIG. 27 is an elevational view of the opposite side of the assembly shown in FIG. 25.
Figure 26:
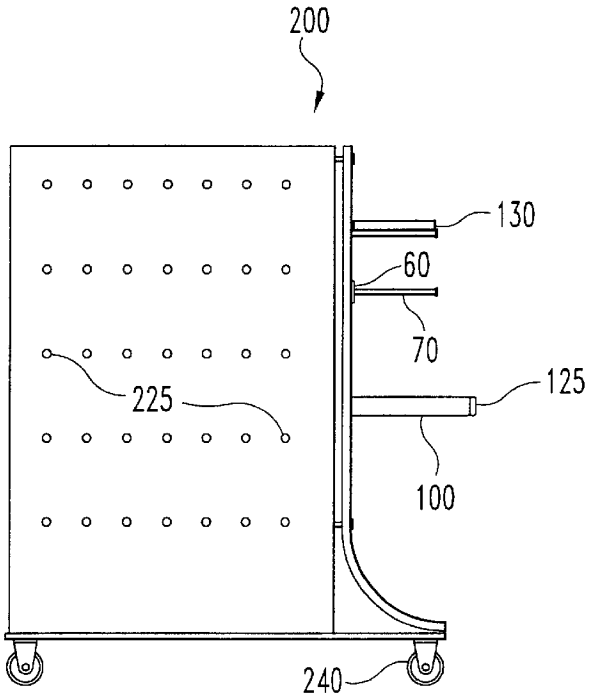
FIG. 26 is a side elevational view of the assembly shown in FIG. 25.
Figure 25:
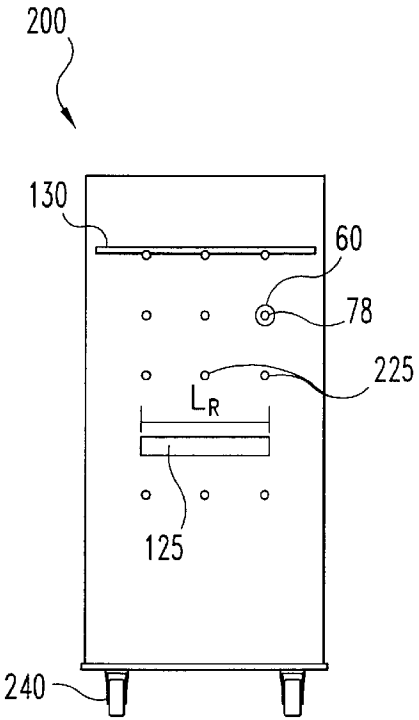
FIG. 25 is a front elevational view of an assembly of this invention.
Figure 31:
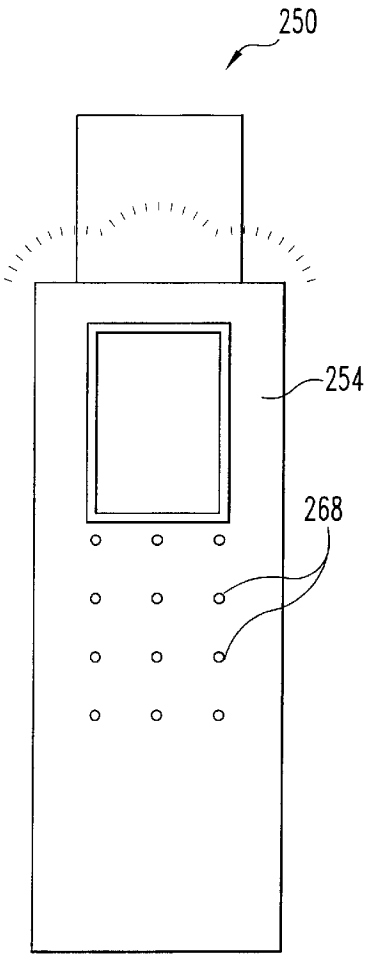
FIG. 31 is an elevational view of the opposite side of the view shown in FIG. 28.
Figure 30:
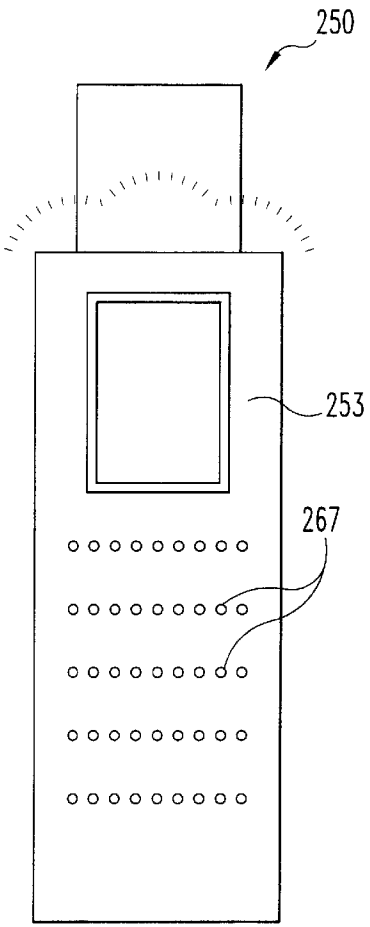
FIG. 30 is an elevational view of the opposite side of the view shown in FIG. 29.

A pair of brackets 100 can be paired on a mounting structure 200, such as the one shown in FIGS. 25–27. Engagement members attached to brackets 100 are each engaged to openings 225 that are spaced at a distance that is appropriate for the length LR of the hang rod 125 or other support member. Bracket 100 has a length LB that is suitable for the particular application of the assembly. For example if a pair of brackets will support a hang bar 125 for hangers, length LB must be greater than one-half on the length of a hanger.

A faceout bracket, such as the one shown in FIG. 7, is also engaged to one of the openings 225 of the fixture shown in FIGS. 25–27. The object support member 70 projects from the support 200 with the retaining member 60 on one end covering the opening 225 and the stop member 78 on an opposite end. Several shelves 130, 135, 140 are also supported on fixture 200 by a number of devices of this invention.

Figure 29:
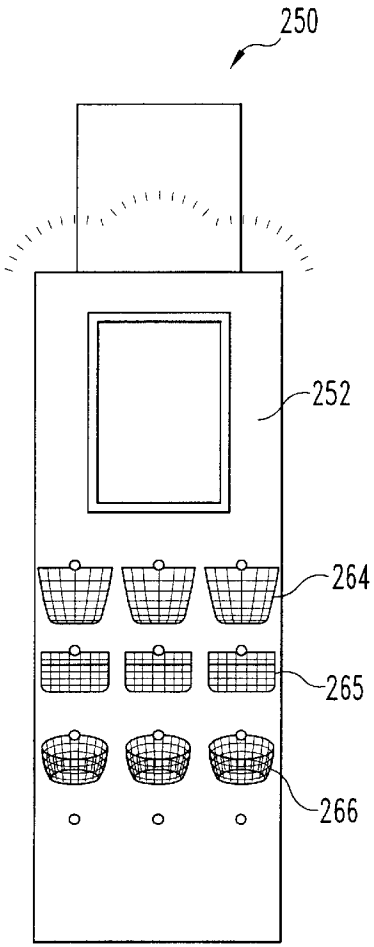
FIG. 29 is a side elevational view of the assembly shown in FIG. 28.
Figure 28:
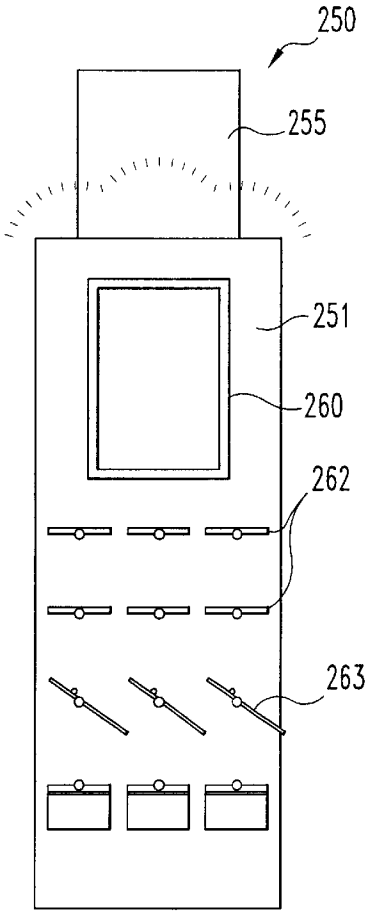
FIG. 28 is a front elevational view of an assembly according to yet another embodiment of this invention.
Figure 34:
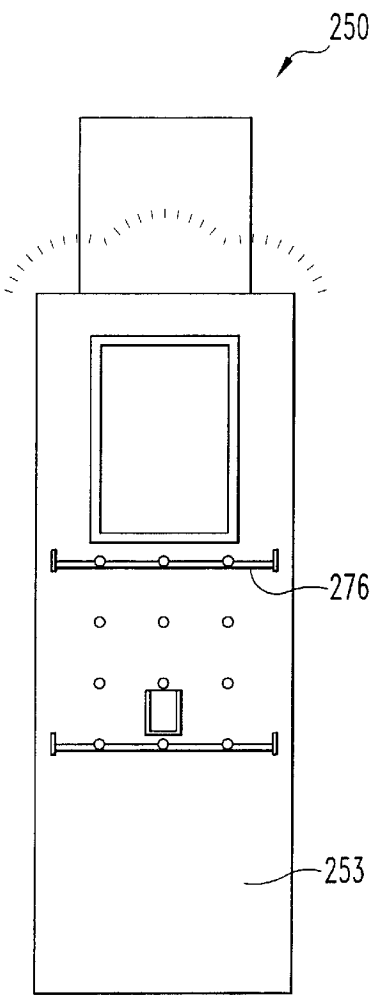
FIG. 34 is an elevational view showing still another arrangement for the side shown in FIG. 31.
Figure 33:
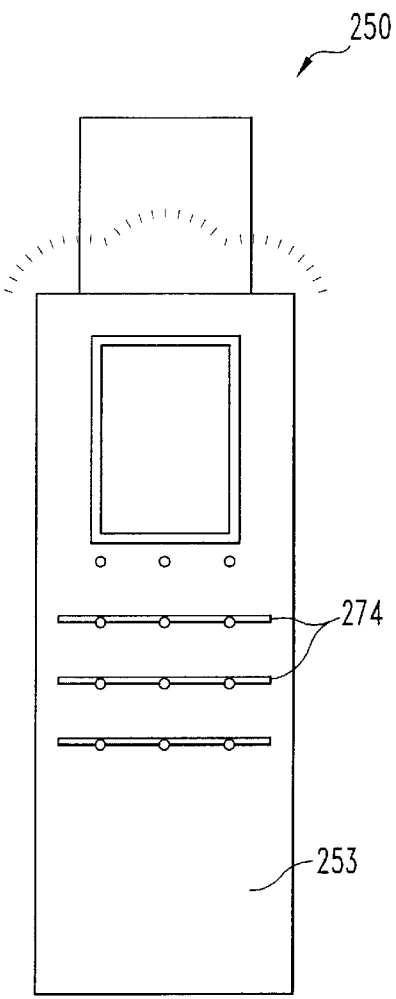
FIG. 33 is an elevational view showing yet another arrangement for the side shown in FIG. 31.
Figure 32:
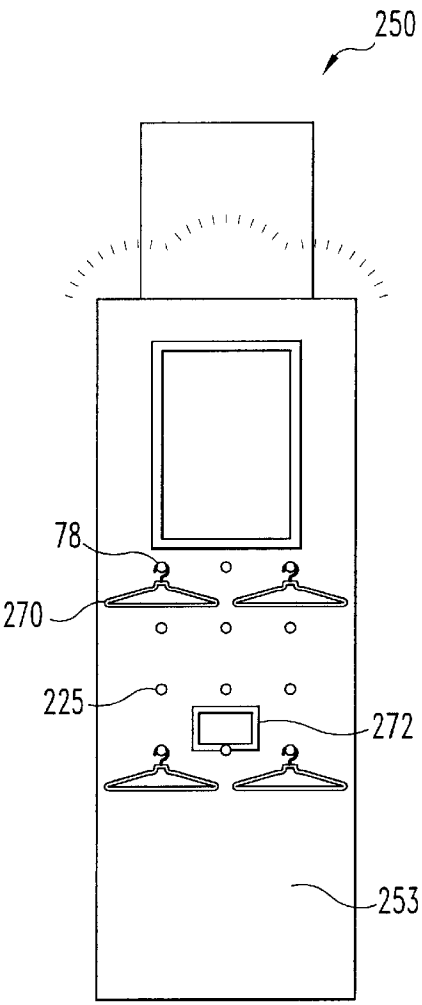
FIG. 32 is an elevational view showing another arrangement for the side shown in FIG. 31.

The present invention allows fixtures to be rearranged easily and efficiently without the need for tools. FIGS. 28–34 show some examples of the virtually unlimited arrangements that can be achieved with the present invention. A variety of accessories can be used to advantageously display and store merchandise and other items. For example, as shown in FIG. 28, one side 251 of fixture 250 is provided with a sign 255 for store or product indicia, a mirror 260, shoe shelves 262 and slanted shoe shelves 263. FIG. 29 shows another side 252 of fixture 250, which supports wire baskets 264, 265, 266 for socks and other small accessory items. Yet another side 253 of fixture 250 is provided a number of belt hooks 267, while the last side 254 has hooks 268 for ties, socks and other accessories. Side 254 can be fitted with brackets in several different ways as shown in FIGS. 31–34. For example, a faceout bracket, such as the one shown in FIG. 7, is engaged to each of four openings for hanging hangers 270 plus a sign bracket 272 in FIG. 32, while shelves 274 are supported in FIG. 33. FIG. 34 shows yet another arrangement with a pair of hang-bars 274 similar to the one depicted in FIGS. 23–24.

It will be appreciated that the assemblies of this invention provide a functional and attractive solution for product displays and/or storage in retail stores, homes and other places. Using a mounting structure 200 or similar device, the invention is extremely versatile. Structure 200 provides for multiple-sided display. Casters 240 or other rolling means can be provided for moving the mounting structure 200. Multiple holes 225 allow for virtually unlimited placement of brackets according to this invention.

Figure 37:
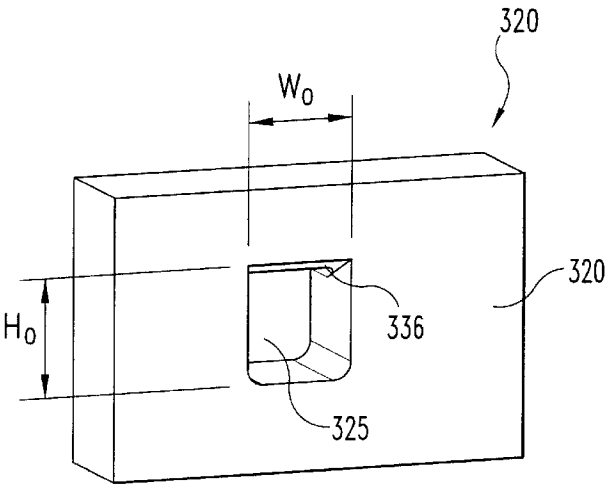
FIG. 37 is a back perspective view of a mounting structure according to one embodiment of this invention.
Figure 36:
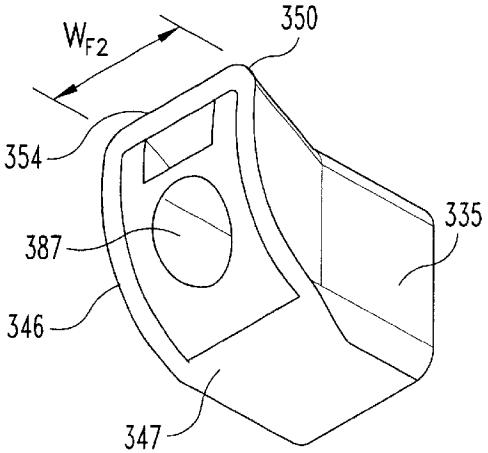
FIG. 36 is a back perspective view of the engagement member shown in FIG. 35.
Figure 35:
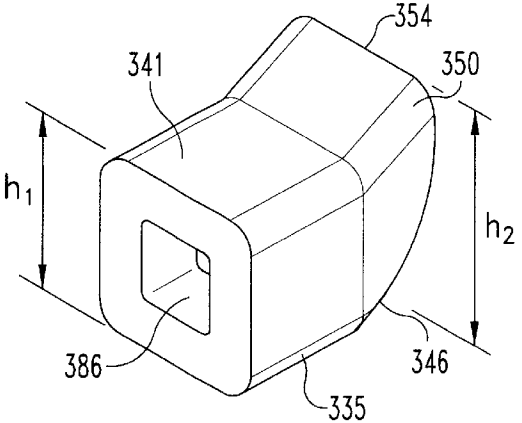
FIG. 35 is a front perspective view of an engagement member according to another embodiment of this invention.

The assemblies of this invention can be provided in any suitable shape and size. For example, the engagement body 335 can be provided with a rectangular cross-section for engaging a rectangular opening 325 in a mounting structure 320 as shown in FIGS. 36–38. A flange 350 projects from a first end 336 of body 335, and a lower cam surface 346 is provided on a lower portion 347 of body 335 as described above for other embodiments. Flange 350 is engageable within a relief 326 defined in mounting structure 320 surrounding a portion of opening 325 at a distance from the first surface (not shown). In one specific embodiment, relief 336 is formed in an opposite surface 322.

Flange 350 includes a leading edge 354 having a width $W_{F2}$ that is smaller than a dimension or width WO of opening 325. Engagement body 335 has a first height $h_1$ between an upper surface 341 and the lower cam surface 346 that is less than a second dimension or height $H_O$ of opening 325 and a second height $h_2$ between leading edge 354 and lower cam surface 346 that is greater than height $H_O$.

As described above for other embodiments, the rectangular embodiments of this invention can be provided with the engagement member (engagement body, flange and retaining member) in a single piece or in separate pieces that can be connected to form the engagement body. The particular embodiment that is shown in FIGS. 36–37 has apertures 386, 387 for engaging fasteners.

The devices of this invention can be provided in any suitable size. For embodiments in which the engagement member (engagement body, flange and retaining member) is provided in more than one piece, the lower limit of size will depend upon the size of the fasteners. For retail clothing stores, for example, it is contemplated that the bore defined in the support will be between about ¾" to about 1¼" in diameter. One of ordinary skill in the art will recognize that the various dimensions of the components can be varied such that the invention is operable for various applications. For example, while the invention has been illustrated for retail fixtures, the invention can be used for many other applications, such as, for example, hanging pictures, mirrors, tools, shelving, light fixtures and speaker holders.

The invention can be manufactured using any suitable materials. In one particular embodiment, the engagement body was stainless steel and the support member was melamine. In another embodiment, the engagement body was plastic. By way of example only, other suitable materials for the support members of this invention include wood, plexiglass, glass and medium density fiberboard.

Other embodiments of the invention will be apparent to those skilled in the art from consideration of the specification and practice of the invention disclosed herein. It is intended that the specification, drawings and examples be considered as exemplary only, with the true scope and spirit of the invention being indicated by the following claims. It should be understood that only the preferred embodiments have been shown and described and that all changes and modifications that come within the spirit of the invention are desired to be protected.

What is claimed is:

1. An assembly for supporting an object, comprising:

a mounting structure having a first surface and an opposite surface and an opening defined therebetween, said opposite surface defining a relief surrounding a portion of said opening;

an engagement body engageable within said opening and a retaining flange projecting from a first end of said body, said flange shaped to be received within said relief, said body defining an upper surface on an upper portion of said body and an opposite lower cam surface on a lower portion of said body, said flange defining a leading edge having a width that is smaller than a width dimension of said opening, said engagement body having a first height between said upper surface and said lower cam surface that is less than a height dimension of said opening and a second height between said leading edge and said lower cam surface that is greater than said height dimension;

a retaining member having a first side and an opposite side attached to an opposite end of said engagement body adjacent said lower cam surface, said opposite side defining a bearing surface; and a cantilever support member having an attached end connected to said first side of said retaining member and an opposite end projecting from said retaining member;

said engagement body engageable within said opening with a portion of said flange disposed within said relief and said bearing surface of said retaining member bearing against said first surface of said mounting structure with said retaining member concealing said opening on said first side of said mounting structure.

2. The assembly of claim 1 wherein said retaining flange is formed at an angle that is from about 10° to about 45° relative to said upper surface and said relief is formed at an angle of between about 45° and about 90° relative to said opposite surface.

3. The assembly of claim 2 wherein said retaining flange is formed at an angle of about 25° relative to said upper surface and said relief is formed at an angle of about 65° relative to said opposite surface.

4. The assembly of claim 1 wherein said lower cam surface is curved.

5. The assembly of claim 1 wherein said body has a rectangular cross-section.

6. The assembly of claim 1 wherein said body tapers from said upper portion to said lower portion.

7. The assembly of claim 6 wherein said width of said upper surface is about 5 to 6 times larger than said width of said lower cam surface.

8. The assembly of claim 6 wherein said body forms a taper angle from said upper portion to said lower portion and said taper angle is between about 0° and 135°.

9. The assembly of claim 8 wherein said taper angle is about 65°.

10. The assembly of claim 9 wherein said width of said leading edge is about 6 to 7 times larger than said width of said lower cam surface.

11. The assembly of claim 1 wherein said opening is a circular bore.

12. The assembly of claim 11 wherein each of said height dimension and said width dimension of said opening equal a diameter.

13. The assembly of claim 11 wherein said relief is defined around at least one third of a circumference of said bore.

14. The assembly of claim 13 wherein said relief is defined around about one half of said circumference of said bore.

15. The assembly of claim 14 wherein said relief is defined around at least one half of said circumference of said bore.

16. The assembly of claim 1 wherein said retaining member is a plate.

17. The assembly of claim 16 wherein said retaining member is circular.

18. The assembly of claim 1 wherein said body projects from an upper portion of said opposite side of said retaining plate and said support member projects from a center portion of said first side of said retaining plate.

19. The assembly of claim 1, further comprising a stop member attached to said opposite end of said support member.

20. An assembly for supporting a cantilever bracket, comprising:

a mounting structure having a first surface and an opposite surface and an opening defined therebetween, said opposite surface including a relief defining a relief surface surrounding a portion of said opening, said relief formed at an acute angle relative to said opposite surface;

an engagement body having a first end and an opposite end, said engagement body engageable within said opening;

a retaining flange projecting from said first end of said engagement body, said retaining flange defining a relief-bearing surface formed at an angle that is complimentary to said acute angle, said engagement member engageable within said opening with said flange disposed within said relief with a portion of said relief-bearing surface of said flange bearing against said relief surface;

a retaining member having a first side and an opposite side, said opposite side defining a bearing surface for bearing against said first surface of said support structure;

a cantilever support member having an attached end connected to said first side of said retaining member and an opposite end projecting away from said retaining member, and a fastener member provided on said opposite side of said retaining member; and a fastener engageable to said engagement body and said fastener member for attaching said retaining member to said engagement member.

21. An assembly for supporting an object, comprising:

a mounting structure having a first surface and an opposite surface and an opening defined therebetween, said opposite surface including a relief defining a relief surface surrounding a portion of said opening, said relief formed at an acute angle relative to said opposite surface;

an engagement member engageable within said opening, said engagement member having a body, a retaining flange projecting from a first end of said body and a retaining member disposed on an opposite end of said body and having a bearing surface, said retaining flange defining a relief-bearing surface formed at an angle that is complimentary to said acute angle;

said engagement member engageable within said opening with a portion of said flange disposed within said relief with a portion of said relief-bearing surface of said flange bearing against said relief surface and said bearing surface of said retaining member bearing against said first surface of said mounting structure; and a cantilever support member having an attached end connected to said opposite side of said engagement member and an opposite end projecting from said engagement member.

22. An assembly for supporting an object, comprising:

a mounting structure having a first surface defining a bore, said mounting structure further defining a bevel surrounding a portion of said bore at a distance from said first surface, said bevel formed at a relief angle;

an engagement member engageable within said bore, said engagement member having a body, a retaining flange projecting from a first end of said body and a retaining member disposed on an opposite end of said body and having a bearing surface, said retaining flange defining a relief-bearing surface formed at an angle that is complimentary to said relief angle of said bevel;

said engagement member engageable within said opening with a portion of said relief-bearing surface of said flange bearing against said bevel, said bearing surface of said retaining member bearing against said first surface of said mounting structure and said retaining member concealing said bore on said first surface of said mounting structure; and an object support member projecting from said retaining member in a direction away from said engagement member.

23. A bracket assembly, comprising:

a mounting structure having a first surface and an opposite surface and a plurality of spaced openings defined therebetween, said opposite surface including a relief defining a relief surface surrounding a portion of each said opening, each said relief formed at an acute angle relative to said opposite surface;

an engagement body having a first end and an opposite end, said engagement body engageable within each said opening;

a retaining flange projecting from said first end of said engagement body, said retaining flange defining a relief-bearing surface formed at an angle that is complimentary to said acute angle, said engagement member engageable within said opening with said flange disposed within said relief with a portion of said relief-bearing surface of said flange bearing against said relief surface;

a plurality of brackets, each said bracket having a retaining member having a first side and an opposite side, said opposite side defining a bearing surface for bearing against said first surface of said mounting structure, a cantilever support member having an attached end connected to said first side of said retaining member and an opposite end projecting away from said retaining member, and a fastener member provided on said opposite side of said retaining member; and a fastener engageable to said engagement body and said fastener member for attaching one of said plurality of brackets to said engagement member.

* * * * *